US008365415B2

(12) United States Patent
Franklin

(10) Patent No.: US 8,365,415 B2
(45) Date of Patent: Feb. 5, 2013

(54) NAIL CLIPPER FOR ACCOMMODATING DECORATIVE COVER

(76) Inventor: Jerome Franklin, Youngstown, OH (US)

( * ) Notice: Subject to any disclaimer, the term of this patent is extended or adjusted under 35 U.S.C. 154(b) by 517 days.

(21) Appl. No.: 12/592,424

(22) Filed: Nov. 24, 2009

(65) Prior Publication Data

US 2010/0132727 A1 Jun. 3, 2010

Related U.S. Application Data

(60) Provisional application No. 61/200,326, filed on Nov. 28, 2008.

(51) Int. Cl.
*A45D 29/02* (2006.01)

(52) U.S. Cl. ..... 30/28; 30/27; 30/124; 132/75.4

(58) Field of Classification Search ..... 30/26, 27, 30/28; 132/73.5, 75.5, 75.6
See application file for complete search history.

(56) References Cited

U.S. PATENT DOCUMENTS

| | | | | | |
|---|---|---|---|---|---|
| 612,990 | A | * | 10/1898 | Kiefaber | 7/162 |
| 846,565 | A | * | 3/1907 | Havell | 30/28 |
| 970,067 | A | * | 9/1910 | Leineweber | 30/29 |
| 2,515,852 | A | * | 7/1950 | Bilsky | 30/28 |
| 2,799,923 | A | * | 7/1957 | Senshu | 30/28 |
| 3,316,632 | A | * | 5/1967 | Bowers | 30/28 |
| 3,997,966 | A | * | 12/1976 | Sartore | 30/28 |
| 4,176,449 | A | | 12/1979 | Lee et al. | 30/28 |
| 5,323,537 | A | * | 6/1994 | Ohori | 30/28 |
| 5,832,610 | A | * | 11/1998 | Chaplick | 30/28 |
| 6,904,683 | B2 | * | 6/2005 | Shinoda et al. | 30/28 |
| 6,941,657 | B2 | | 9/2005 | Choi et al. | 30/28 |
| 6,941,658 | B2 | | 9/2005 | Park | 30/28 |
| 7,020,964 | B2 | | 4/2006 | Han et al. | 30/28 |

FOREIGN PATENT DOCUMENTS

| | | | |
|---|---|---|---|
| CN | 2884966 | Y * | 4/2007 |
| JP | 2006204559 | A * | 8/2006 |
| JP | 2006311994 | A * | 11/2006 |
| JP | 2009106598 | A * | 5/2009 |

* cited by examiner

*Primary Examiner* — Kenneth E. Peterson
*Assistant Examiner* — Jennifer Swinney

(57) ABSTRACT

A nail clipper configuration accommodates permanent three dimensional covers on the front of the nail clipper by limiting the necessary movement of the operating handle to move from the stored position to the operating position.

12 Claims, 2 Drawing Sheets

NAIL CLIPPER FOR ACCOMMODATING DECORATIVE COVER

PRIORITY INFORMATION

The present invention claims priority to U.S. Provisional Application No. 61/200,326 filed on Nov. 28, 2008, making reference to same in its entirety and incorporating same herein.

FIELD OF INVENTION

The present invention relates generally to nail clippers, such as those that are provided with an operating handle for applying pressure to bring together a pair of cutting edges. More particularly, the present invention is directed to nail clippers in which the operating handle is configured to accommodate a decorative three-dimensional cover arranged on the front of the nail clippers.

BACKGROUND OF THE INVENTION

The type of nail clipper to which the present invention is directed generally includes a body having an upper flexible member and a lower flexible member, connected at one end thereof, and having cutting edges at the opposite end. The cutting edges are configured to be brought together under pressure. The operating handle is connected to a holding pin adjacent the cutting edges. The holding pin is configured to keep the two, preferably flat, flexible members a predetermined distance apart. The holding pin is also used to anchor the operating handle so that pressure can be applied, forcing the upper flexible member against the lower flexible member, with the holding pin providing an anchor for the fulcrum that is applied to the upper flexible member by the operating handle.

The operating handle is the key to the entire configuration. In a stored position, it lies flat along the upper spring providing a slim configuration. This position of the operating handle also permits it to be accessed easily to move the entire apparatus into an operating configuration.

Conventional nail clippers of this type require that the operating handle be lifted and rotated about. It is normal for the operating handle to be rotated approximately 180° and then rotated around so that the top of the handle faces in a direction opposite that occupied in the stored position. A structure on the bottom of the handle serves as a pressure point and a fulcrum so that when the handle is pressed down, part of it is held by the holding pin and the upper flexible member acts as a spring when it is pressed down toward the second flexible member. This develops sufficient force so that a cutting operation can take place using the blades at the ends of the flat spring-like structures.

While the action of moving the operating handle from the stored position to the operating position is rather awkward, this does not constitute a problem in most conventional nail clippers. However, there are drawbacks in certain situations. For example, usually two hands are needed to move the handle from the stored position to the operational position. Additional space is also needed for this operation. If one-handed use is required, or a constricted area is imposed upon the user, then the use of such conventional nail clippers becomes problematic at best.

Conventional nail clippers are so common that they are very often used in merchandising and advertising. Normally this is done by simply placing text, trademarks, images and the like on the various flat surfaces of the nail clipper. This is an easy process, and admits readily to mass distribution for advertising purposes.

However, not all advertising and merchandising can be carried out using plane surfaces. A substantial amount of merchandising is carried out using three dimensional models and images. For example, logos in the form of three dimensional depictions of mascots (such as those for schools, corporations and the like) are very common. Because of the wide-spread use of conventional nail clippers with mass advertising and merchandising, the marketing and merchandising of various images with conventional nail clippers would appear to be a natural combination. However, such a combination is impractical with conventional nail clippers.

Generally, any three dimensional structure that is fit onto the nail clipper is forced off or damaged when moving the nail clipper handle for the stored position to the operating position. Consequently, the marketing of three dimensional covers or images is impractical with conventional nail clippers. This drawback is true of all the conventional nail clippers considered. These include the arrangements of: U.S. Pat. No. 6,941,657 to Choi, et al.; U.S. Pat. No. 6,941,658 to Park; U.S. Pat. No. 6,904,683 to Shinoda, et al.; U.S. Pat. No. 4,176,449 to Lee, et al.; and U.S. Pat. No. 7,020,964 to Han, et al. All of these patents are incorporated herein by reference.

Improvements upon these designs, as well as all of the others in the conventional art directed to nail clippers would include nail clippers that could be used with three dimensional decorative covers. Such decorative covers could remain on the nail clippers at all time, and would not have to be removed or suffer damage when moving the nail clipper operating handle back and forth from the stored position to the operating position. Such improved nail clippers would readily admit to easy marketing in conjunction with three dimensional images or designs.

SUMMARY OF INVENTION

Accordingly, it is a principle object of the present invention to overcome the drawbacks of conventional nail clippers, especially with respect to mounting three dimensional decorative covers on the nail clippers.

It is another object of the present invention to provide nail clippers having simplified operation when moving the operating handle back and forth from the stored position to the operating position.

It is a further object of the present invention to provide nail clippers that take up less space than conventional nail clippers when moving the handle from the stored position to the operating position.

It is an additional object of the present invention to provide nail clippers that can accommodate a wide variety of three dimensional decorative covers, without necessitating removal of those covers or damage to those covers when moving the operating handle back and forth from the stored position to the operating position.

It is still another object of the present invention to provide an arrangement of a nail clipper and a decorative cover wherein the cover is arranged to facilitate the function of the nail clippers.

It is yet a further object of the present invention to provide a combination of nail clippers and three dimensional cover, wherein the cover expresses the function of the nail clipper.

These and other goals and objects of the present invention are achieved by a nail clipper configuration arranged to accommodate a three dimensional cover for a nail clipper having two flexible members, each joined at a first end and each having opposed transverse blades at a second end. The flexible members are attached to a holding pin adjacent to the transverse blades, and the nail clipper has a handle operatively connected to the holding pin. The nail clipper further includes a pivot structure at one end of the handle and a bearing structure containing the pivot structure in both the operating position and the stored position for the handle. A locking mechanism is arranged so that the handle is moved from the stored position to the operating position solely by moving the pivot structure up and down within the bearing structure.

DETAILED DESCRIPTION OF PREFERRED EMBODIMENTS

Figure 1:
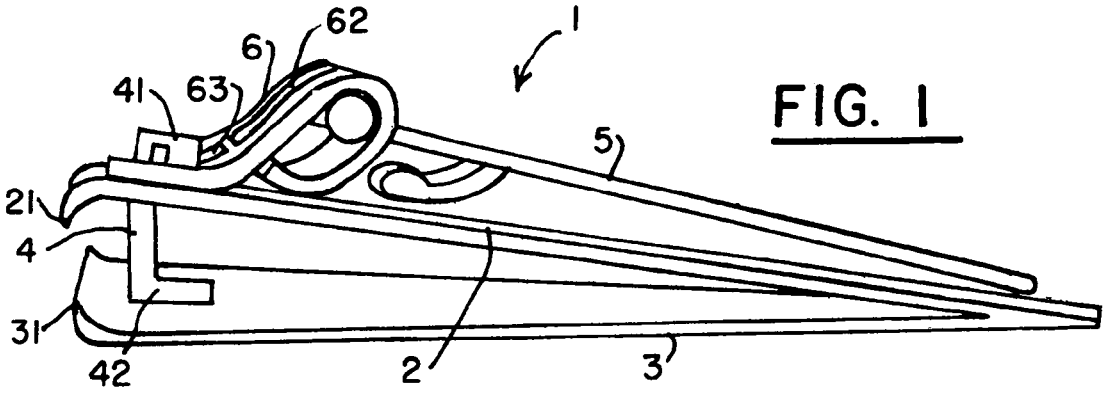
FIG. 1 is a side view of the present invention with the operating handle in the stored position.

FIG. 1 is a side view with a slight perspective depicting the present invention with operating handle 5 in the stored position. The basic nail clipper structure has a number of parts that are very similar or virtually the same to those conventional nail clippers. In particular, the upper flexible member 2 is connected at one end to lower flexible member 3. Preferably, both of the flexible members are flat, as is common with conventional nail clippers. The nature of the material constituting flexible members 2 and 3 (metal or appropriate plastic), as well as the connection between them at one end, constitutes an assembled structure that operates in a spring-like manner. As a result, when the flexible members 2, 3 are forced together, they will spring apart once the force is removed.

Opposite the connection between flexible members 2, 3, each flexible member has a transverse blade 21, 31 respectively. The two flexible members are held at a predetermined distance apart by holding pin 4. Part of pin 4 is the lower connecting part 42 which securely connects to lower flexible member 3. Holding pin 4 also includes an upper holding cap 41 that fits over flexible member 2. Upper holding cap 41 also holds bearing structure 6 to the top of flexible member 2. The use of this additional element is a substantial departure from conventional nail clippers.

Figure 2:
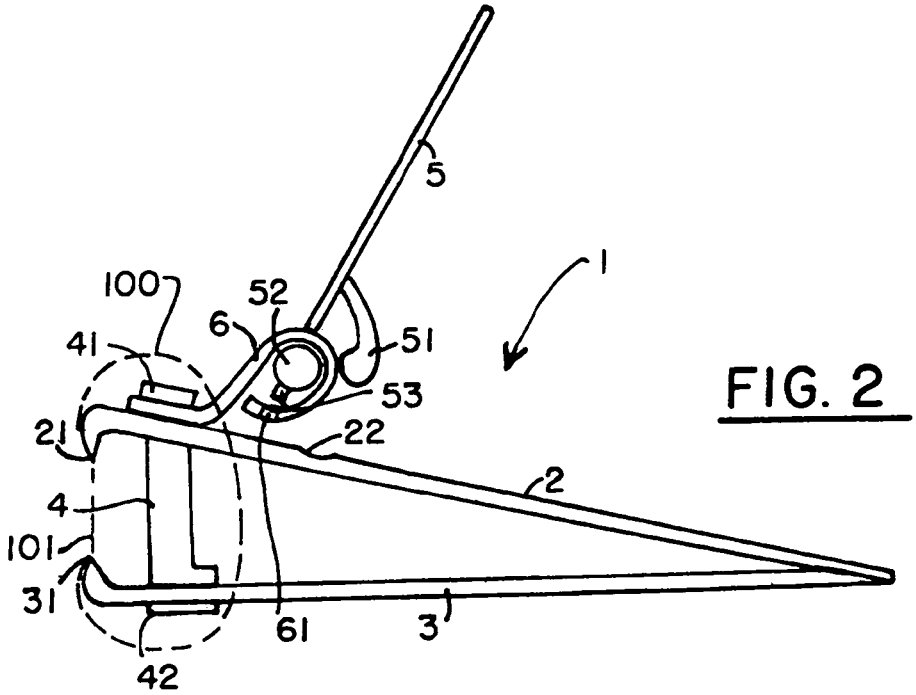
FIG. 2 is a side view of the present invention with the operating handle ready to be placed in the operating position.

A major distinction over the conventional art resides in the bearing structure 6 and the use of a pivot structure 52 at the end of operating handle 5. The pivot structure 52 is held loosely in the bearing structure 6 so that handle 5 can lie against upper flexible member 2 (as depicted in FIG. 1), or can be lifted, thereby moving pivot structure 52 downward into the operating position (as depicted in FIG. 2). This is a crucial difference with the present invention, permitting a decorative three dimensional cover 100 to be applied over the front of nail clipper 1. The decorative cover 100 can be applied permanently since operating handle 5 does not interfere with it during the shift between operating or storage positions.

When the handle 5 is used to operate the nail clippers, forcing down flexible member 2 to bring together the two transverse blades 21, 31, the pivot structure 52 is moved downwards within bearing structure 6. This allows locking pin or protrusion 53 to be inserted into locking pin aperture 61, thereby rigidly locking the handle 5 into the bearing structure 6. Movement of the handle 5, within the bearing structure 6, is facilitated by release aperture 62 which permits an arc of movement for handle 5, thus, pivot structure 51 is both rotated and shifted vertically within the bearing structure 6.

Once handle 5 is locked into bearing structure 6 (by means of locking pin 53), handle 5 can be moved downwards in the normal cutting motion used with this type of nail clipper. As this is done, fulcrum piece 51 slides along the outside of bearing 6 until fulcrum piece 51 reaches indentation 22 in flexible member 2. Once this occurs, further pressure on handle 5 forces flexible member 2 toward flexible member 3 so that a cutting action can be effected by transverse blades 21, 31. The fulcrum action of fulcrum piece 51 when force is exerted on handle 5 is facilitated by the structure of bearing piece 6 being permanently connected to upper holding cap 41, so that all force is transmitted into moving upper flexible member 2 towards lower flexible member 3.

When the cutting operations are finished, the natural spring action of bearing piece 6 (as well as flexible members 2, 3) brings handle 5 up to the position depicted in FIG. 2. Then, handle 5 need only be pulled upwards a slight amount to release locking pin or protrusion 53 from locking pin aperture 61. At which point, handle 5 can be placed back into the stored position depicted in FIG. 1.

This limited range of movement for handle 5 to operate nail clipper 1 is significant because it permits a three dimensional cover 100 (usually a decorative cover) to be placed as depicted on the nail clipper 1 without interfering with the operation of the nail clipper. It should be noted that conventional nail clippers require that handle 5 be rotated about in order to moved from the stored position to the operating position. Such movement would force removal or destruction of three dimensional cover 100. This detriment is avoided by the configuration and operation of the present invention depicted in FIGS. 1-3.

Figure 3:
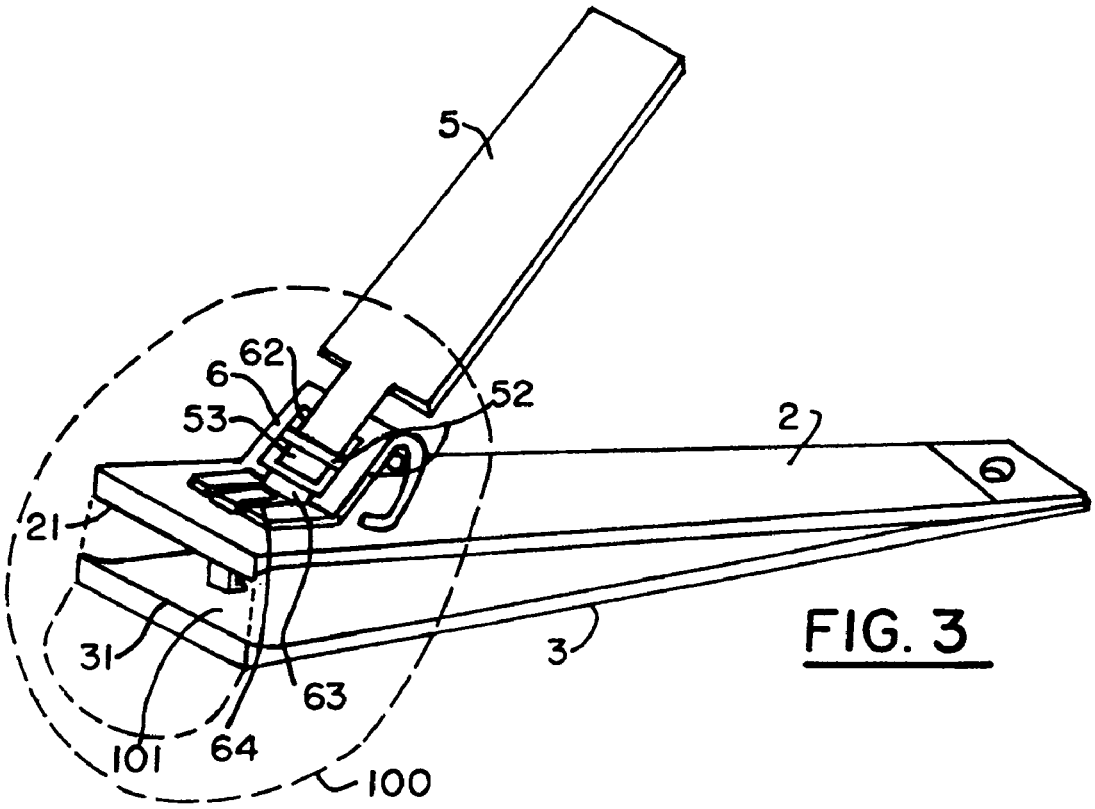
FIG. 3 is a perspective view of FIG. 2 with the operating handle readied to be placed into the operating position.

Further, the decorative cover can easily be configured to have an aperture 101 (as depicted in FIGS. 2 and 3) through which the operation of the nail clippers can be effected without disturbing the decorative cover, or limiting the function of the nail clipper.

As a result, decorative three dimensional covers can be placed permanently on nail clippers configured according to the present invention. As such, this type of nail clipper can be used extensively for promotional projects, advertising, or merchandising of logos, mascots, celebrities, and the like. The present invention provides the operation of a conventional nail clipper while still permitting the addition of permanent covers that can be used in advertising or promotion, or even sold for their own sake.

While at least one preferred embodiment has been described by way of example, the present invention is not limited thereto. Rather, the present invention should be interpreted to encompass all variations, modifications, permutations, derivations, and embodiments that would occur to one skilled in this technology having possession of the teachings of the present invention. Accordingly, the present invention should be construed as being limited only by the following claims.

I claim:

1. A nail clipper arranged to accommodate a three dimensional cover, said nail clipper having two flexible members each joined at a first end and each having opposed transverse blades at a second end, said flexible members being attached by a holding pin adjacent and perpendicular to said transverse blades, and having a handle operatively connected to said holding pin, said nail clipper comprising:

a) a cylindrical pivot structure connected at one end of said handle;

b) a bearing structure that pivots relative to said holding in and surrounds and contains said cylindrical pivot structure in both an operating position and a stored position for said handle; and, c) a locking mechanism comprising a locking protrusion extending from said cylindrical pivot structure and a locking in aperture located in said bearing structure so that in a stored position, said handle lies adjacent an upper flexible member with said cylindrical pivot structure being moved to an upper portion of said bearing structure, and when said handle is raised in an operating position, said locking protrusion is received in said locking in aperture to rotationally lock said handle and said bearing structure relative to each other, thereby locking said cylindrical pivot structure in a lower portion of said bearing structure.

2. The nail clipper of claim 1, further comprising:

d) a three dimensional cover arranged from said blades to a position adjacent and forward of said cylindrical pivot structure when said handle is in said operating position.

3. The nail clipper of claim 2, wherein said three dimensional cover comprises an aperture at a space between said opposing transverse blades.

4. The nail clipper of claim 2, wherein said three dimensional cover comprises an aperture located at said opposing blades arranged to give operational access to said opposing blades.

5. The nail clipper configuration of claim 2, wherein said three dimensional cover is permanently attached to said nail clipper configuration.

6. The nail clipper of claim 5, wherein the said handle does not come into contact with said three dimensional cover during operation of said nail clipper.

7. The nail clipper configuration of claim 1, wherein said handle further comprises a fulcrum piece arranged to slide beneath said bearing structure and constitute a fulcrum for said handle to transmit force to said opposing blades.

8. The nail clipper configuration of claim 7, further comprising an indentation on an upper flexible member, said indentation positioned to receive said fulcrum during operation of said nail clipper.

9. The nail clipper configuration of claim 8, wherein said bearing structure further comprises a release aperture permitting passage of said handle from a stored position to an operating position.

10. The nail clipper configuration of claim 9, wherein said bearing structure further comprises a pin aperture to accommodate passage of said holding pin through bearing structure.

11. The nail clipper configuration of claim 1, wherein said nail clipper configuration is made of plastic.

12. The nail clipper configuration of claim 1, wherein said nail clipper configuration is made metal.

* * * * *